US010493644B2

(12) United States Patent
Bozikis et al.

(10) Patent No.: US 10,493,644 B2
(45) Date of Patent: Dec. 3, 2019

(54) RAZOR SYSTEM

(71) Applicant: BIC VIOLEX S.A., Anixi (GR)

(72) Inventors: Ioannis Bozikis, Athens (GR); Spiros Gratsias, Athens (GR); Ioannis Marios Psimadas, Athens (GR); Vasileios Stamoulis, Anixi (GR)

(73) Assignee: BIC VIOLEX S.A., Anixi (GR)

( * ) Notice: Subject to any disclaimer, the term of this patent is extended or adjusted under 35 U.S.C. 154(b) by 60 days.

(21) Appl. No.: 15/816,556

(22) Filed: Nov. 17, 2017

(65) Prior Publication Data

US 2018/0207824 A1 Jul. 26, 2018

(30) Foreign Application Priority Data

Jan. 24, 2017 (EP) ..... 17152934

(51) Int. Cl.
*B26B 21/40* (2006.01)
*B26B 21/52* (2006.01)
*B26B 21/22* (2006.01)

(52) U.S. Cl.
CPC ..... *B26B 21/4037* (2013.01); *B26B 21/225* (2013.01); *B26B 21/4012* (2013.01); *B26B 21/521* (2013.01)

(58) Field of Classification Search
CPC ..... B26B 21/4037; B26B 21/4012; B26B 21/225; B26B 21/521
USPC ..... 30/537; D28/47
See application file for complete search history.

(56) References Cited

U.S. PATENT DOCUMENTS 3,287,803 A * 11/1966 Wauters ..... B26B 21/40 30/539
D210,713 S * 4/1968 Hamill ..... 30/539
4,587,730 A * 5/1986 Iten ..... B26B 21/4037 30/32
4,709,476 A * 12/1987 Shurtleff ..... B26B 21/44 30/41
5,893,213 A * 4/1999 Motta ..... B26B 21/4037 30/539
D629,969 S * 12/2010 Wonderley ..... D28/47
8,499,459 B2 * 8/2013 Efthimiadis ..... B26B 21/225 30/34.1
9,539,734 B1 * 1/2017 Bozikis ..... B26B 21/227
2009/0172957 A1 * 7/2009 Prudden, Jr. ..... B26B 21/4037 30/539
2011/0005089 A1 * 1/2011 Sennett ..... B26B 21/4037 30/539

(Continued)

FOREIGN PATENT DOCUMENTS

EP 2 231 371 B1 10/2012
EP 3 351 357 A1 * 7/2018

*Primary Examiner* — Hwei-Siu C Payer
(74) *Attorney, Agent, or Firm* — Bookoff McAndrews, PLLC

(57) ABSTRACT

A protector (40) for a shaving razor (10) including a handle (12) removably attached to a cartridge (22). The protector (40) includes a housing (42) for receiving and protecting the cartridge (22). The housing (42) includes a bottom wall (43), an upper wall (44) and lateral walls (45, 46, 47, 48), the upper wall (44) being provided with a first opening (49) for receiving the handle (12), and the protector (40) further including a guiding member (50) for guiding the handle (12) toward the cartridge (22) when the handle (12) is being attached to the cartridge (22).

13 Claims, 10 Drawing Sheets

(56) References Cited

U.S. PATENT DOCUMENTS

| | | | | |
|---|---|---|---|---|
| 2011/0203124 | A1* | 8/2011 | Bridges | B26B 21/4037 30/539 |
| 2017/0151683 | A1* | 6/2017 | Bozikis | B26B 21/227 |
| 2018/0207824 | A1* | 7/2018 | Bozikis | B26B 21/4037 |

* cited by examiner

RAZOR SYSTEM

CROSS REFERENCE TO RELATED APPLICATION

This application claims priority to European application EP17152934.0, filed on Jan. 24, 2017, the entire contents of which is incorporated herein by reference.

BACKGROUND

1. Field

The disclosure relates to a protector for a shaving razor and a razor system including a protector. More particularly, the disclosure relates to a protector including a protective function for a shaving razor and a guiding function for the handle. The disclosure also relates to a method for attaching a handle to a cartridge with a protector, and a method for removing a protector when a handle is attached to a cartridge.

2. Description of Related Art

Shaving razors commonly include a handle and a cartridge. The handle is removably and pivotally attached to the cartridge, so that the cartridge, or the handle, can be thrown away when it is worn. It may be important to protect the cartridge and the pivoting attachment between the cartridge and the handle, which can be damaged, for example, in case of a.

Some conventional protectors for shaving cartridges include inhibiting members that engage a pivoting and removable attachment between the cartridge and a handle of the shaving razor, thus preventing the cartridge from pivoting with respect to the handle. In many instances, the handle can be attached to the cartridge incorrectly, therefore damaging the attachment between the cartridge and the handle and creating safety issues for the user.

SUMMARY

Aspects of the disclosure involve a shaving razor including a handle removably attached to a cartridge. The cartridge may include a protector. The protector may include a housing for receiving and protecting the cartridge. The housing may include a bottom wall, an upper wall and lateral walls. The upper wall may be provided with a first opening for receiving the handle, and the protector may further include a guiding member for guiding the handle toward the cartridge when the handle is being attached to the cartridge. Hence, the protector may facilitate guiding the user with attaching the cartridge to the handle in a correct orientation.

Further aspects of the disclosure may involve, one or more of the following features, either alone or in combination:

- a guiding member configured to extend from the upper wall of the housing, the guiding member slightly extending over the handle, when connected to the cartridge, in instances involving a shaving razor with a pivot movement of the cartridge relative to the handle, the guiding member being configured to inhibit movement of the cartridge;
- a guiding member including a front wall;
- the front wall being provided with an outer flap and the outer flap having one or more bumps, the bump(s) serving as finger rest area for the user, thereby directing the user when locking the protector onto the cartridge;

- a front wall extending over the first opening of the upper wall of the housing wherein the protector facilitates guiding the handle towards the cartridge at the correct angle;
- the front wall of the guiding member being formed at an acute angle $\alpha$ with respect to the upper wall of the housing;
- the angle $\alpha$ being between 35 degrees and 70 degrees or 40 and 60 degrees wherein the inclination of the angle $\alpha$ forces the user to orient and attach the handle of the shaving razor correctly with respect to the cartridge;
- a guiding member including a side wall;
- the side wall of the guiding member being configured to form an angle with the upper wall of the housing such that the side wall provides structural reinforcement to the front wall;
- the side wall and the front wall of the guiding member being continuous such that the side wall and the front wall form a path for guiding the handle toward the cartridge, thereby easing attachment of the handle on the cartridge;
- a lateral wall of the housing including a second opening for sliding the cartridge into the housing, the protector being slid on the cartridge to protect the cartridge and being capable of being removed for shaving, the protector may also have an indicator, such as an arrow, showing the sliding direction;
- the shaving razor including a handle and a cartridge, the handle being removably attached to a cartridge;
- the handle including a first connecting portion, and the cartridge including a second connecting portion, and the first and the second connecting portions being adapted to be connected together; and
- the side wall of the guiding member and the first connecting portion of the handle being spaced from each other by a distance in a range including between 0.1 mm and 10 mm or 0.2 mm and 5 mm. Further objects of the present disclosure may pertain to methods for attaching a handle to a cartridge, thereby forming a razor system, the cartridge being protected by the protector as described above, in which when the handle is being attached to the cartridge, the handle follows a path formed by the front wall and the side wall of the guiding member of the protector.

Further objects also include methods for removing the protector as described above from a razor system. The razor system including a handle connected to a cartridge, the protector being removed from the razor system by sliding the cartridge through the second opening of the housing of the protector. The razor may thus be used for shaving. After shaving, the protector may be slid again on the cartridge to protect the cartridge from being contaminated, and to protect the user from inadvertently being cut. In addition, the guiding member may prevent the handle from being inadvertently detached from the cartridge.

BRIEF DESCRIPTION OF THE DRAWINGS

Other characteristics and advantages of the disclosure will readily appear from the following description of aspects, provided as non-limitative examples, in reference to the accompanying drawings.

DETAILED DESCRIPTION

Figure 1:
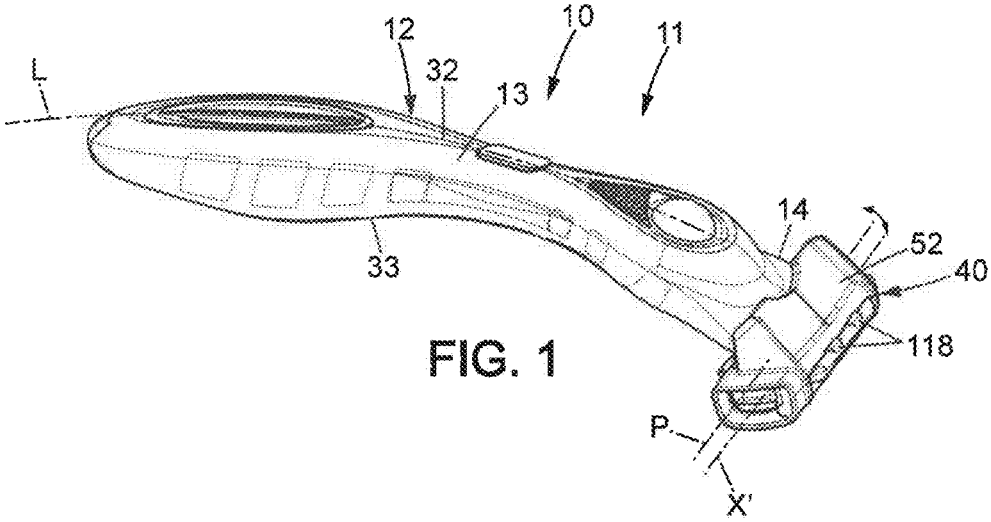
FIG. 1 is a perspective view of the razor system.
Figure 2:
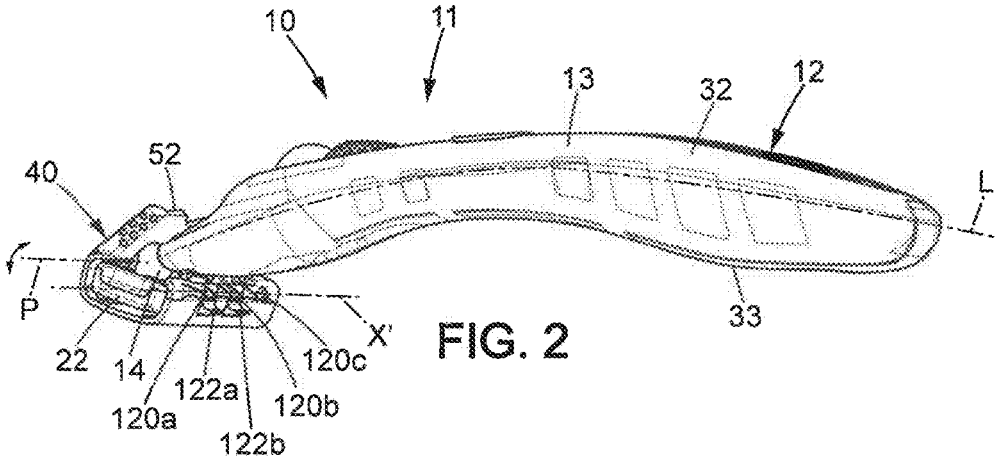
FIG. 2 is another perspective view of the razor system of FIG. 1.

Aspects of the disclosure, as detailed in FIGS. 1 and 2, involve a razor system 11, that may include a protector 40 and a shaving razor 10. The shaving razor 10 may include a handle 12 and a cartridge 22. The handle 12 and the cartridge 22 may be removably attached together. In addition, the cartridge 22 may rotate relative to the handle 12, about a pivot axis P.

Figure 3:
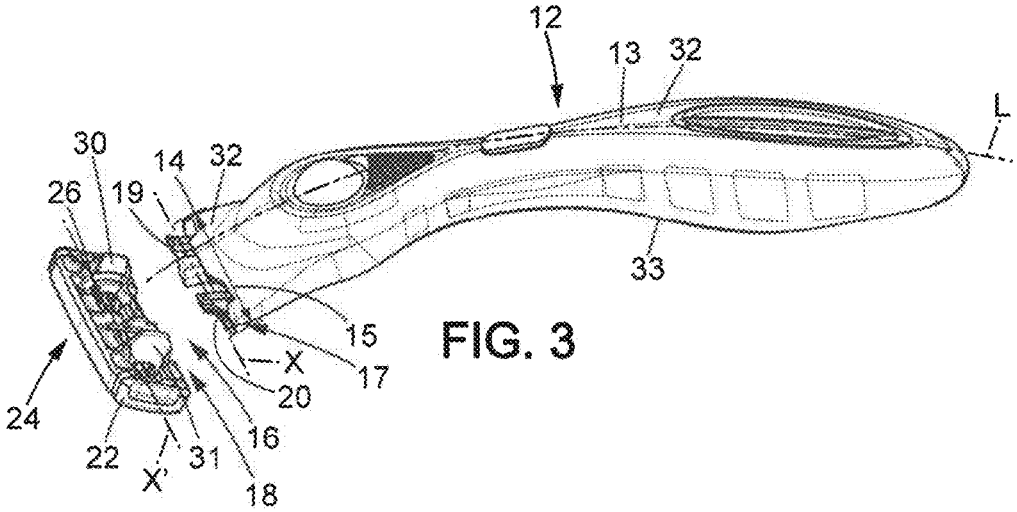
FIG. 3 is an exploded perspective top view of the razor system of FIG. 1.
Figure 4:
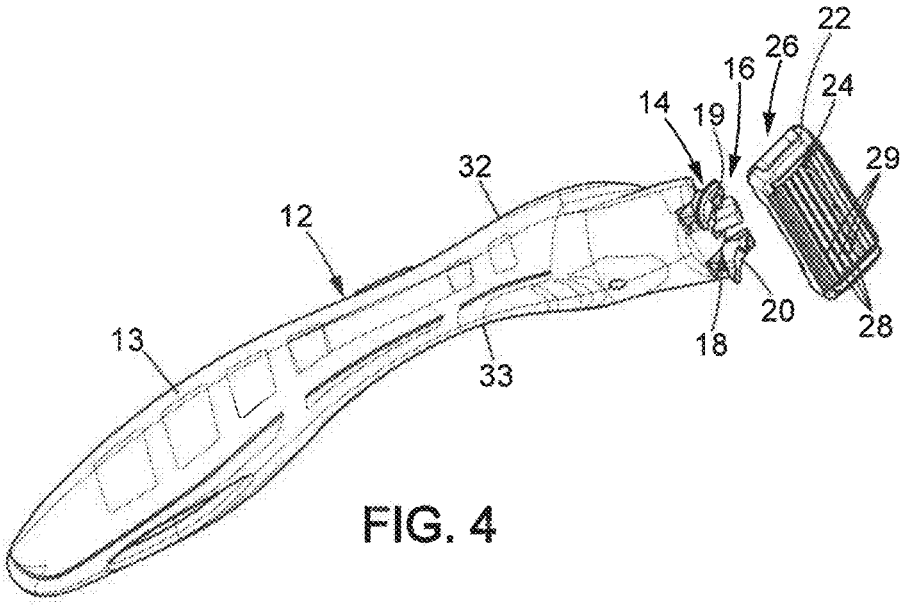
FIG. 4 is an exploded perspective bottom view of the razor system of FIG. 1.

As depicted in FIGS. 3 and 4, the handle 12 may include a body 13, extending along a longitudinal direction L, and a front portion 14. The front portion 14 may have a width 15 along a first transverse axis X, of, for example, between 10 mm and 40 mm according to some aspects and may be, for example, between 25 mm to 35 mm according to other aspects. The width 15 of the front portion 14, according to further aspects, may be about 30 mm. The front portion 14 may be provided for attachment of the shaving handle 12 with the cartridge 22. The front portion 14 and the cartridge 22 may include an attachment mechanism 16. The attachment mechanism 16 may selectively connect the cartridge 22 to the handle 12 or release the cartridge 22 from the handle 12, in order, for example, to change the cartridge 22 when the cartridge may be worn. More particularly, the attachment mechanism 16 may include a first connecting portion 17 and a second connecting portion 18. The first and the second connecting portions 17 and 18 may be made, for instance, of various moldable materials such as plastic. The handle 12 may include the first connecting portion 17 and the cartridge 22 may include the second connecting portion 18.

The first connecting portion 17 may extend toward two free ends, on both sides of the front portion 14 of the handle 12. The free ends of the first connecting portion 17 may be provided, respectively, with a first bearing 19 and a second bearing 20. The first bearing 19 and the second bearing 20 may be, for example, shell bearings. The shell bearings may extend outwardly of the front portion 14 of the handle 12.

The cartridge 22, as shown in FIG. 2, may extend along a second transverse axis X'. The cartridge 22 may include a front surface 24 and a rear surface 26. The cartridge 22 may further include elongated blades 28. Each elongate blade 28 may have a cutting edge 29 extending along the second transverse axis X'. The cutting edges 29 may be on the side of the front surface 24 of the cartridge 22. FIG. 4 details a cartridge 22 with three elongate blades 28. However, the cartridge 22 according to aspects of the disclosure may not be limited to only three elongate blades 28. For example, the cartridge 22 may be provided with at least one elongate blade 28 and up to ten elongate blades 28. According to some aspects, the cartridge 22 may be provided with five blades 28. The cartridge 22, may include the second connecting portion 18. The second connecting portion 18 may include a first protruding connector 30 and a second protruding connector 31. The first and second protruding connectors 30 and 31 may be located opposite the cutting edge 29. Thus, the first and second protruding connectors 30 and 31 may be disposed on the side of the rear surface 26. The first and second protruding connectors 30 and 31 may be provided to engage, respectively, the first and the second bearings 19 and 20 of the handle 12. The shapes of the first and second protruding connectors 30 and 31 may be complementary to the shapes of the first and the second bearings 19 and 20 of the handle 12. Complementing shapes may allow for a pivot movement of the cartridge 22 relative to the handle 12.

Regarding the arrangement of the different axes with respect to one another, the pivot axis P is parallel to the first transversal axis X. The second transversal axis X' is parallel to the first parallel axis X. The pivot axis P is parallel to the second transversal axis X'.

Figure 5:
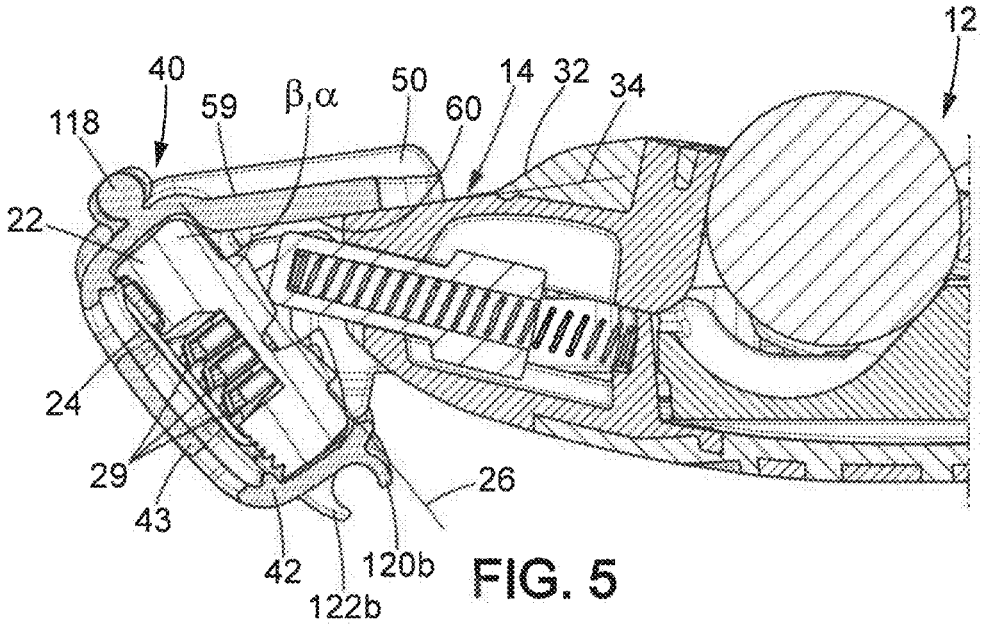
FIG. 5 is a cross-sectional view of the razor system of FIG. 1 in rest position.
Figure 6:
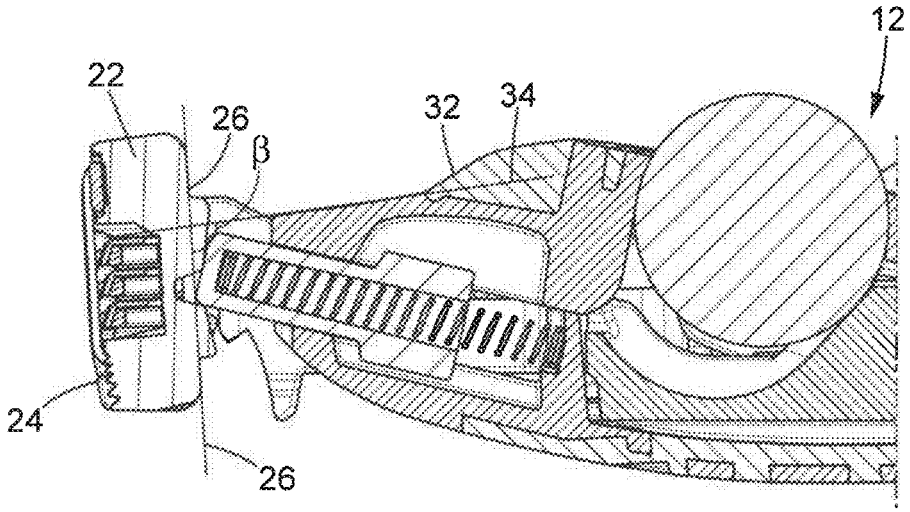
FIG. 6 is a cross-sectional view of the shaving system of FIG. 1 in the extended position.

According to some aspects, the shaving razor 10 may include two extreme positions. For instance, the two extreme positions may be a rest position (FIG. 5), and an extended position (FIG. 6). The extended position may correspond to the position resulting from the pivot movement of the cartridge 22 in relation with the handle 12. In the rest position, the handle 12 may be positioned at an angle β of about 55 degrees, for example, with the cartridge 22. The angle β may, in some aspects, be an acute angle. According to further aspects, angle β may be, for example, between 35 degrees and 70 degrees, and in other aspects, between 40 degrees to 60 degrees. The handle 12 may have an outer surface. The outer surface of the handle 12 may include a front surface 32 and a back surface 33. The front surface 32 of the handle 12 may coincide with a tangent line 34, as shown in FIG. 5. The angle β may be defined as the angle between the tangent line 34 and the rear surface 26 of the cartridge 22.

Figure 7:
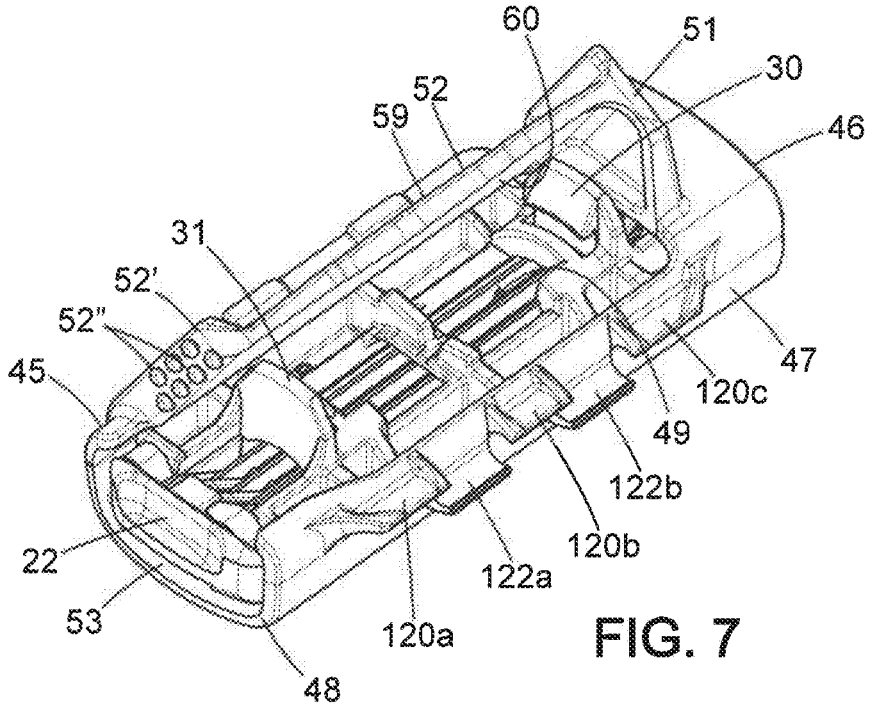
FIG. 7 is a perspective top view of the protector and the cartridge.

According to further aspects, the protector 40, as illustrated in FIGS. 1, 2 and 6, may include a housing 42 and a guiding member 50. The housing 42 may be shaped for receiving the cartridge 22 of the shaving razor 10. The inner shape of the housing 42 may be similar to the outer shape of the cartridge 22. The housing 42 may include a bottom wall 43, an upper wall 44 and lateral walls 45, 46, 47 and 48. The upper wall 44 may include a first opening 49 for attaching the cartridge to the handle 12. The first opening 49 may be provided to slide the cartridge 22 inside the housing 42. There may be four lateral walls: a first lateral wall 45, a second lateral wall 46, a third lateral wall 47 and a fourth lateral wall 48. Two of the lateral walls may have dimensions that are identical. According to some aspects, two opposite lateral walls may have identical dimensions. As illustrated in FIG. 7, the length of the first lateral wall 45 may be larger than the length of the second lateral wall 46. The length of the second lateral wall 46 may be smaller than the length of the third lateral wall 47. The length of the third lateral wall 47 may be larger than the length of the fourth lateral wall 48. The first and the third lateral walls 45 and 47 may be opposite and may have lengths which may be identical. The second and the fourth lateral walls 46 and 48 may be opposite and may have lengths which may be identical. The fourth lateral wall 48 may have a second opening 53. The second opening 53 may be provided to slide the cartridge 22 into the housing 42.

Figure 10:
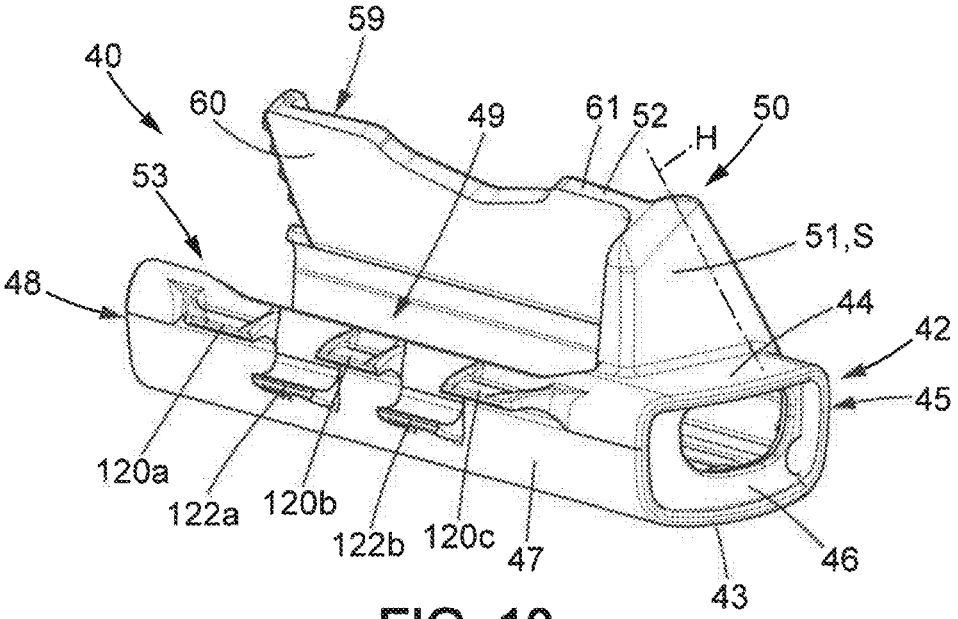
FIG. 10 is a perspective view of the protector.

According to some aspects, the protector 40 may further include a guiding member 50. The guiding member 50 may extend away from the upper wall 44 of the cartridge 22. More precisely, the guiding member 50 may include a side wall 51 and a front wall 52. As shown in FIG. 10, the side wall 51 and the front wall 52 may define a part of the edge of the first opening 49 of the upper wall 44. The side wall 51 and the front wall 52 may be joined together, and may form, for example, a right angle (i.e. 90 degrees) with each other.

The front wall 52 may be provided with an outer flap 52'. This outer flap 52' may extend opposite the first opening 49 of the upper wall 44. The outer flap 52' may be provided with one or more bumps 52". The number of bumps 52" may be seven, but is not limited to this number. The bumps 52" may serve as finger rest area for the user, directing the user when locking the protector 40 onto the cartridge 22.

Figure 9:
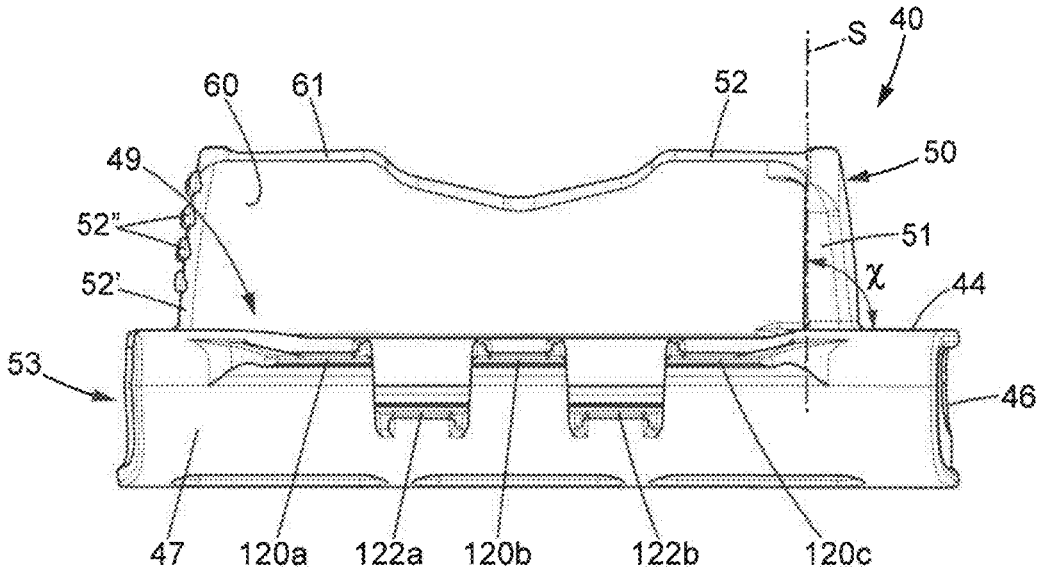
FIG. 9 is a front view of the protector.
Figure 12:
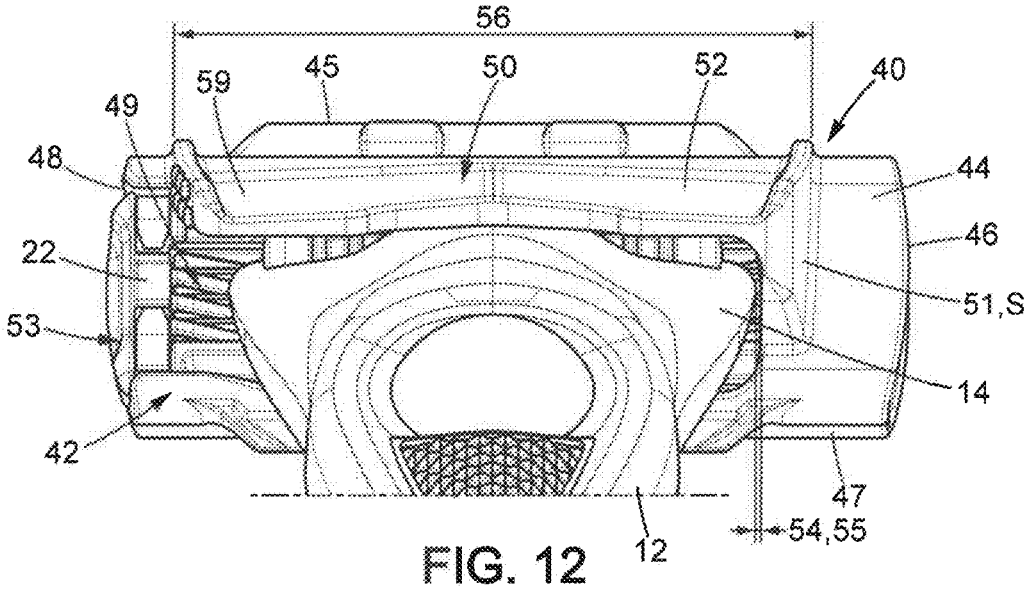
FIG. 12 is a top view of the razor system, in the area of the front portion of the handle.

The side wall 51 may extend from the upper wall 44 of the housing 42. According to some aspects, as shown in FIG. 9, the side wall 51 may extend in a plane S perpendicular to the upper wall 44 of the housing 42. The side wall 51 may function to protect the cartridge 22 to handle 12 attachment, for example in case of a shock, such as from being dropped, hit, banged, smacked, etc. In other words, the side wall 51 may serve as a cover for the attachment between the cartridge 22 and the handle 12. When the protector 40 is slid on the shaving razor 10, as shown for example in FIG. 12, there may be a gap 54 between the bearing 19, being the nearest to the side wall 51, among the first and the second bearings 19 and 20. The gap 54 may separate the bearing 19, being the nearest to the side wall 51, and the side wall 51 at a distance 55 which may be, for example, between 0.1 mm and 10 mm in some aspects, and 0.2 mm and 5 mm, according to other aspects. The gap 54 may provide a safe distance between the bearing 19 that is the nearest to the side wall 51 and the side wall 51. In an instance of shock, such as for example, by being dropped, hit, banged, smacked, etc., the side wall 51 may be impacted first. The side wall 51 may serve as a shield or may be deformed or may even brake. The distance 55 of the gap 54 may be provided to prevent transmission of an occurrence of shock to the nearest bearing 19. The nearest bearing 19 may thus be protected against shock.

Figure 11:
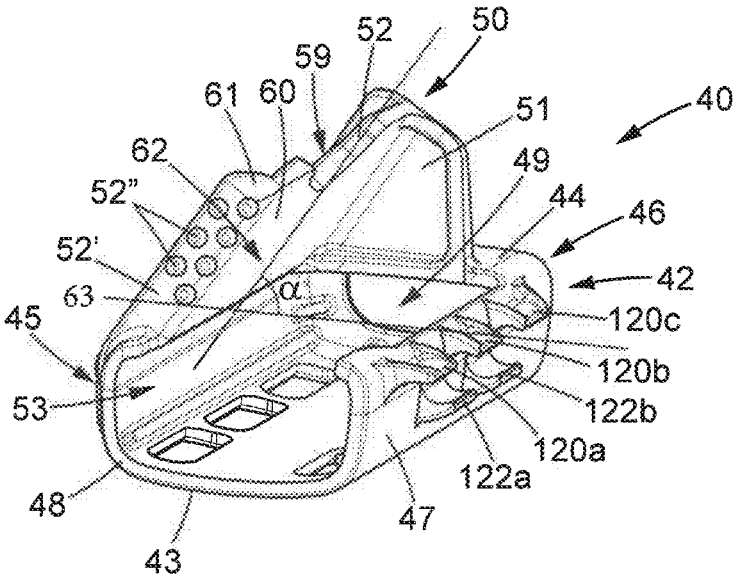
FIG. 11 is a perspective top view of the protector of FIG. 10.
Figure 13:
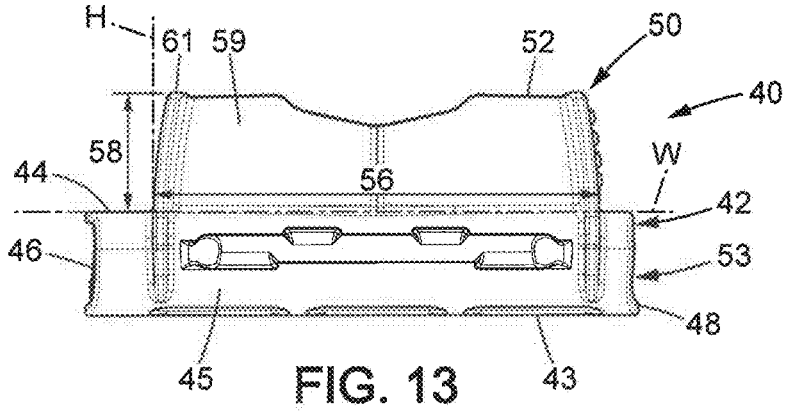
FIG. 13 is another front view of the protector.
Figure 14:
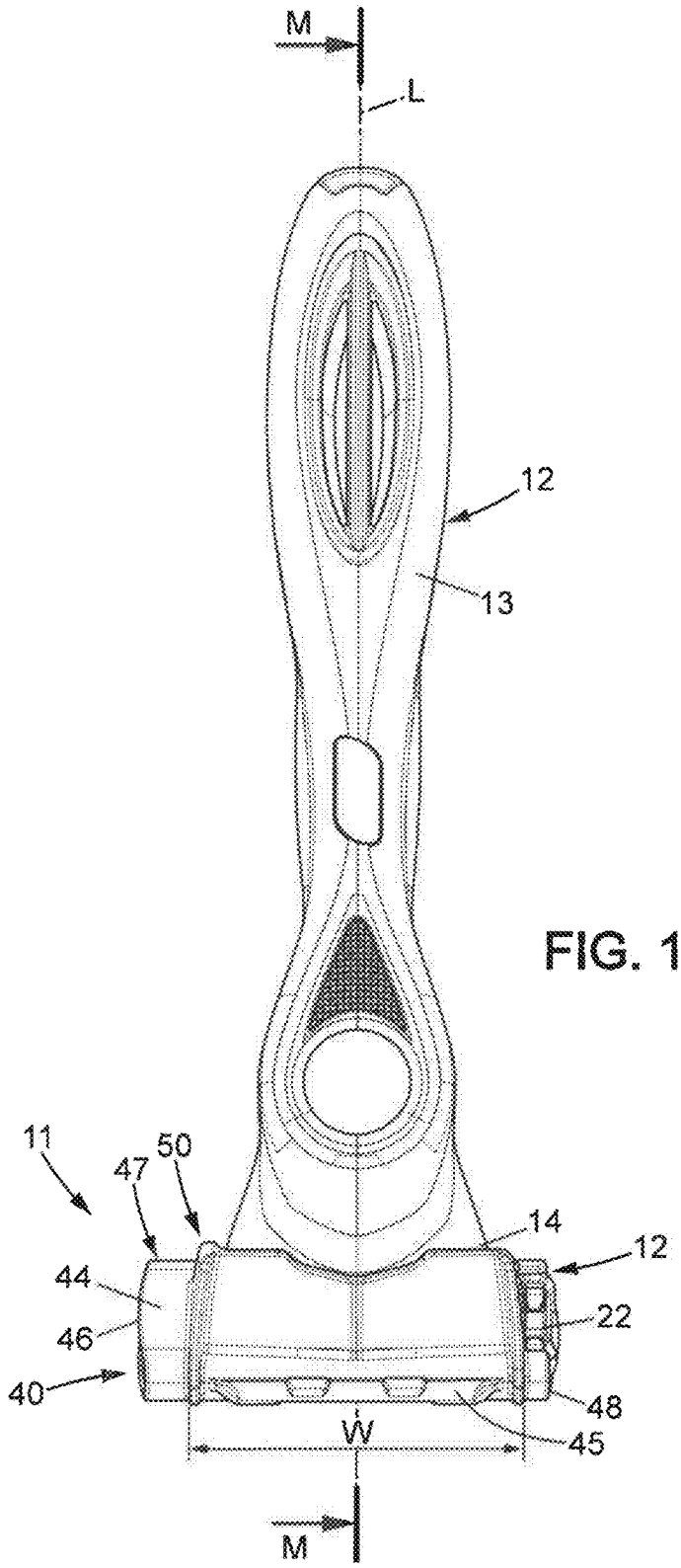
FIG. 14 is a top view of the razor system of FIG. 1.
Figure 15:
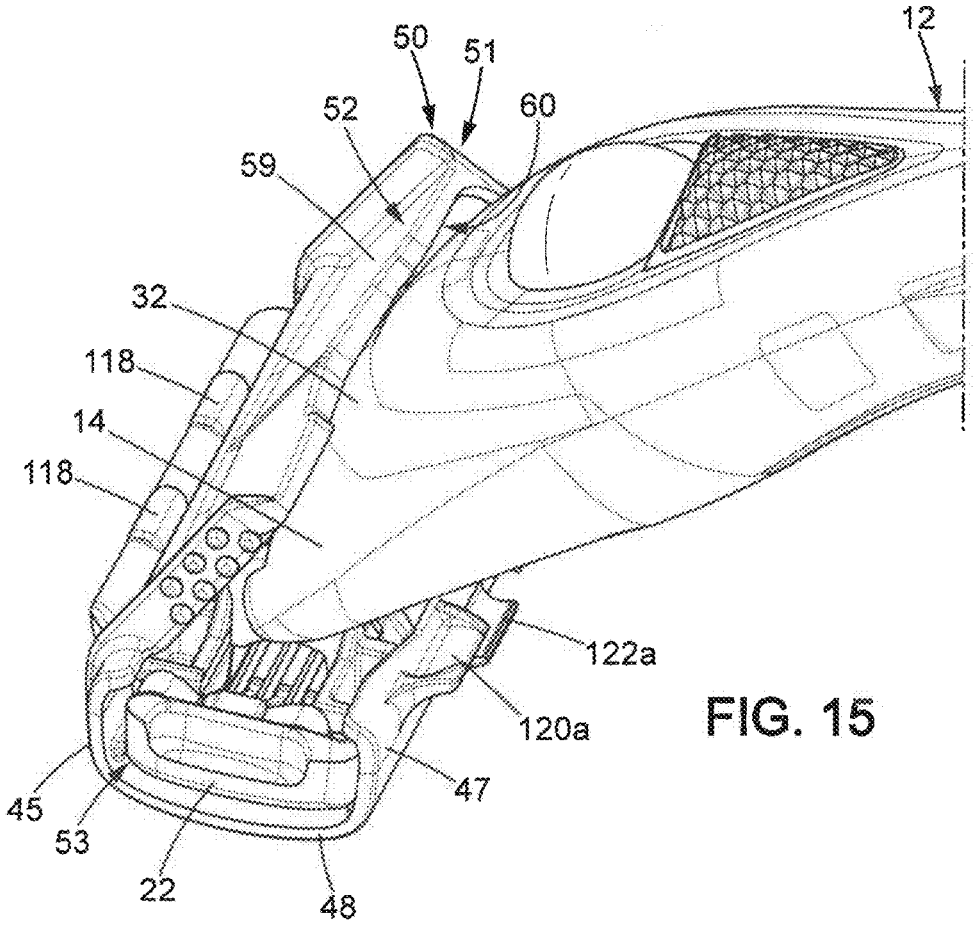
FIG. 15 is a perspective view of the protector of FIG. 12.
Figure 16:
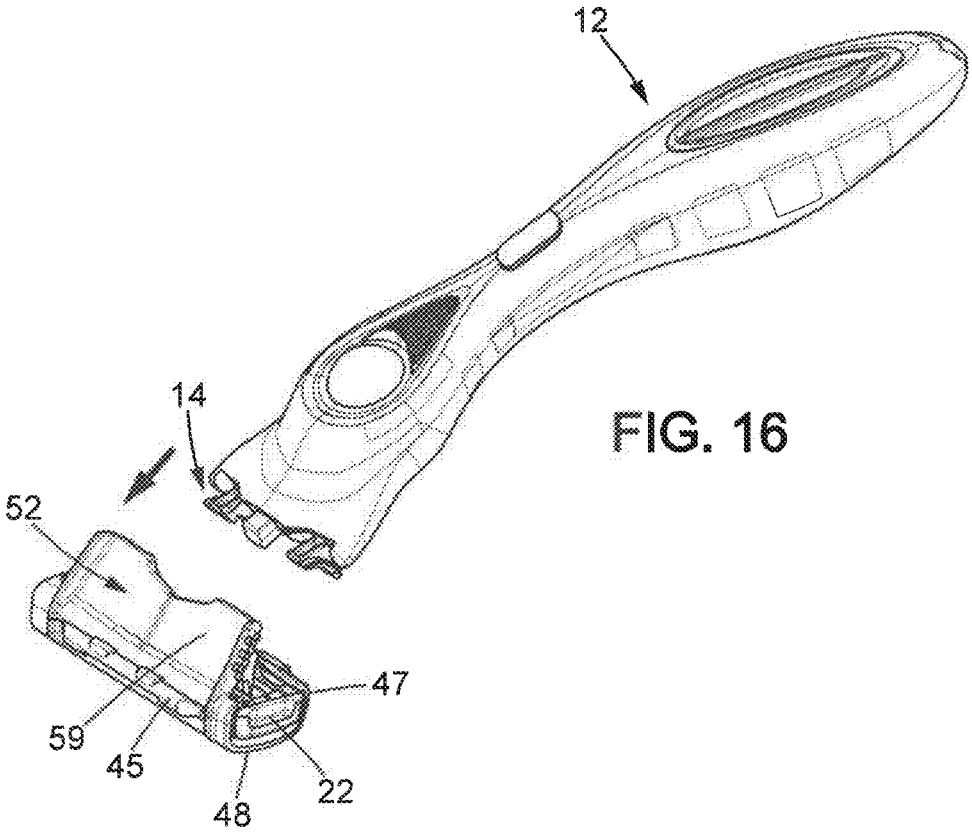
FIG. 16 is an exploded perspective view of the razor system of FIG. 1.

FIGS. 10, 11 and 13 illustrate the front wall 52 wherein the front wall 52 may extend over the first opening 49 of the upper wall 44 of the housing 42. The front wall 52 may have a free end 61, which may be opposite to the upper wall 44. The front wall 52 may have a width 56, for example, of between 15 mm and 400 mm, along the axis W. The width 56 of the front wall 52 may be the largest, closest to the upper wall 44, where the upper wall 44 contacts the housing 42. The largest value of the width 56 of the front wall 52 should be, for example, at least larger than the width 15 of the front portion 14 of the handle 12. According to some aspects, the width 56 of the front wall 52 may be, for example, about 30 mm. The front wall 52 may have a height 58, along an axis H. The height 58 may be measured between the upper wall 44 of the housing 42 and the free end 61 of the front wall 52. The height 58 of the front wall 52 may be a height to sufficiently cover the front portion 14 of the handle 12. For example, the height 58 of the front wall 52 may be between 3 mm and 15 mm. According to other aspects, the height 58 of the front wall 52 may be about 9 mm. As shown for example in FIG. 11, the front wall 52 may extend over the first opening 49 of the upper wall 44 of the housing 42. The front wall 52 may also be tilted at an acute angle $\alpha$ relative to the upper wall 44 of the housing 42. The angle $\alpha$ may generally correspond to the angle $\beta$ between the handle 12 and the cartridge 22, when the shaving razor 10 is in a rest position. The angle $\alpha$ may be chosen according to the shape of the handle 12. Hence, as shown in FIG. 5, the front wall 52 of the guiding member 50 may have an outer surface 59 and an inner surface 60 extending approximately parallel to the outer surface 59. The shape of the inner surface 60 of the front wall 52 may match with the overall shape of the front surface 32 of the handle 12, in the area of the front portion 14. Therefore, the inner surface 60 may correspond with a tangent line 62 which may form an acute angle $\alpha$ with a tangent plane 63 that corresponds with the upper wall 44 of the housing 42. The angle $\alpha$ may be identical or slightly larger than the angle $\beta$. For example, the angle $\alpha$ may be between 35 degrees and 70 degrees or, according to other aspects, may be between 40 degrees and 60 degrees. According to further aspects, the angle $\alpha$ may be about 55 degrees. The angles $\alpha$ and $\beta$ may allow for suitable cooperation between the handle 12 and the guiding member 50. As such, when assembled on the shaving razor 10, as shown in FIGS. 14 and 15, the guiding member 50 may be slightly above the upper wall 44 of the housing 42 along the front portion 14 of the handle 12. The front wall 52 and the side wall 51 may facilitate guiding the handle 12 toward the cartridge 22, when the handle 12 may be attached to the cartridge 22.

The present disclosure further concerns a method for attaching the handle 12 to the cartridge 22. The method may include placing the cartridge 22 in the housing 42 of the protector 40. The handle 12 may then be advanced toward the assembly including the protector 40 and the cartridge 22. When the handle 12 reaches the guiding member 50, the guiding member may assist the handle 12 in following the path formed by the front wall 52 and the side wall 51 of the guiding member 50 and the handle may be directed towards the cartridge 22. In other words, the guiding member 50 may serve to ensure a foul-proof attachment of the handle 12 to the cartridge 22. Hence, the handle 12 may be properly attached to the cartridge 22. The handle 12, the cartridge 22 and the protector 40 may therefore form a razor system 11. The razor system 11, including the protector 40, may now be well protected. More precisely, the cartridge 22 may not be detached inadvertently from the handle 12. The protector 40 may also assist with protecting the cartridge 22 from dust. Also, since the protector 40 covers the cutting edges 29 of the blades 28, no risk may exist of inadvertently cutting with the razor system 11.

The present disclosure may also involve a method for removing the protector 40 from the shaving razor 10. As such, the protector 40 may be removed from the razor system 11 by sliding the shaving razor 10 through the second opening 53 of the housing 42 of the protector 40. The shaving razor 10, in this configuration, may be ready for use in shaving.

As shown in FIGS. 1-2, 5, and 8-16, the protector 40 may be provided with connecting means which may allow the protector 40 to be releasably attached to one or more other protectors 40 so as to form, for example, a string of multiple protectors 40.

Figure 8:
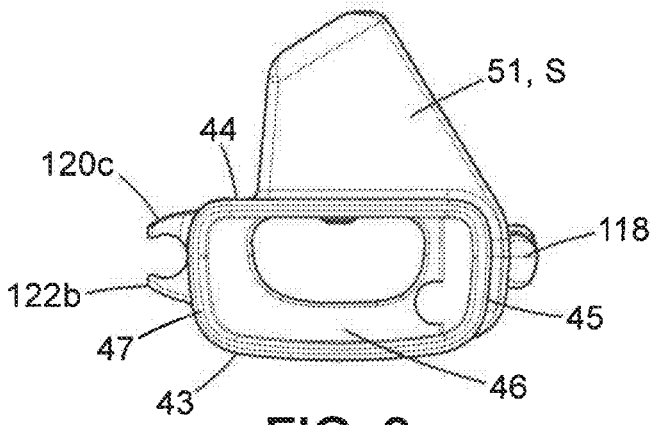
FIG. 8 is a side view of the protector.

More precisely, the lateral wall 45 may be provided with one or more elongated projection(s) 118. The one or more elongated projection(s) 118 may be, for example, rounded in cross-section (as best seen in FIGS. 5 and 8) and may be disposed lengthwise along the longitudinal axis of the lateral wall 45. The lateral wall 47 may, according to some aspects, be provided with two rows of projections, a top row of projections 120*a*, 120*b*, and 120*c* and a bottom row of projections 122*a* and 122*b*. The projections 120*a*, 120*b*, and 120*c* in the top row may be a curved-concave downward shape, and the projections 122*a* and 122*b* in the bottom row may be a curved-concaved upward shape. Together, the top and bottom rows of the curved-concave downward and curved-concaved upward projections 120*a*, 120*b*, 120*c* and 122*a*, 122*b*; respectively, may form a slot capable of interconnectingly receiving an element having the same shape as the elongated projection(s) 118. The disclosure is not limited to the three projections 120*a*, 120*b*, and 120*c* on the top row and two projections 122*a* and 122*b* on the bottom row, is understood that any number of projections may be used. Also, the projection 118 on lateral wall 45 may be formed as a plurality of projections 118 rather than as a single, elongated projection 118.

The projections 118 on lateral wall 45 and lateral wall 47 may enable the interlocking connection of multiple protectors 40 (not depicted in the figures). The protectors 40 may be connected together by sliding the elongated projection 118 of one protector 40 into the slot formed by the downward and/or upward curved-concave shapes of projections (120*a*, 120*b*, 120*c*, 122*a*, and 122*b*) on lateral wall 47 of another protector. According to other aspects, the projections on lateral wall 47 may be manufactured from a resiliently yieldable material, and the elongated projection 118 may be snapped into the slot formed by the downward and/or upward curved-concave shapes of the projections on lateral wall 47 by pushing the elongated projection 118 into the slot. The present disclosure allows any number of protectors 40 to be connected together. Moreover, the protectors 40 may be attached and detached as needed.

The invention claimed is:

1. A protector for a shaving razor, comprising:

a housing and a guiding member;

the housing including a bottom wall, an upper wall opposite the bottom wall, and opposing lateral walls;

the upper wall being provided with a first opening, and the guiding member including a front wall having an outer surface and an inner surface extending parallel to the outer surface, the outer surface forms an acute angle with the upper wall of the housing for guiding a handle of the shaving razor toward a cartridge of the shaving razor when the handle is being attached to the cartridge, and the front wall extends over the opening of the upper wall.

2. A protector according to claim 1, wherein the guiding member extends from the upper wall of the housing.

3. A protector according to claim 1, wherein the front wall is provided with an outer flap and wherein the outer flap includes one or more bumps.

4. A protector according to claim 1, wherein the acute angle formed between the outer surface of the front wall and the upper wall of the housing is between 35 degrees and 70 degrees.

5. A protector according to claim 1, wherein the guiding member further includes a side wall.

6. A protector according to claim 5, wherein the side wall of the guiding member forms a right angle with the upper wall of the housing.

7. A protector according to claim 5, wherein the side wall and the front wall of the guiding member are continuous.

8. A protector according to claim 1, wherein at least one of the opposing lateral walls of the housing further includes a second opening for sliding the cartridge into and out of the housing.

9. A method for removing the protector of claim 8 from a razor system, the razor system comprising the shaving razor and the protector, wherein the handle is connected to the cartridge having the protector disposed thereon, the method including removing the protector from the razor system by sliding the cartridge through the second opening and out of the housing of the protector.

10. A razor system comprising the shaving razor and the protector according to claim 1, wherein the shaving razor includes a handle and a cartridge, the handle being removably attached to the cartridge.

11. A razor system according to claim 10, wherein the handle includes a first connecting portion, the cartridge including a second connecting portion, and wherein the first and the second connecting portions are adapted to be connected together.

12. A razor system according to claim 11, wherein a side wall of the guiding member and the first connecting portion of the handle are spaced from each other by a distance in a range of between 0.1 mm and 10 mm.

13. A method for attaching a handle to a cartridge, the cartridge being protected by a protector mounted on the cartridge, wherein the protector includes a housing and a guiding member;

the housing including a bottom wall, an upper wall opposite the bottom wall, and opposing lateral walls;

the upper wall being provided with a first opening;

the guiding member including a front wall having an outer surface and an inner surface extending parallel to the outer surface, the outer surface forms an acute angle with the upper wall of the housing, and the front wall extends over the first opening of the upper wall;

the method comprising attaching the handle to the cartridge by moving the handle toward the first opening and following a path formed by the front wall and a side wall of the guiding member of the protector so that the handle engages the cartridge to attach the handle to the cartridge.

* * * * *